US010312628B2

(12) United States Patent
Zhang

(10) Patent No.: US 10,312,628 B2
(45) Date of Patent: Jun. 4, 2019

(54) ELECTRICAL CONNECTOR WITH FORWARD AND REARWARD WATERPROOF SEALING

(71) Applicant: Molex, LLC, Lisle, IL (US)

(72) Inventor: Xue-Hai Zhang, Kunshan (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/918,189

(22) Filed: Mar. 12, 2018

(65) Prior Publication Data

US 2018/0269617 A1 Sep. 20, 2018

(30) Foreign Application Priority Data

Mar. 14, 2017 (CN) ..... 2017 2 0244877 U

(51) Int. Cl.
*H01R 13/508* (2006.01)
*H01R 13/52* (2006.01)
(Continued)

(52) U.S. Cl.
CPC ..... *H01R 13/508* (2013.01); *H01R 13/405* (2013.01); *H01R 13/5216* (2013.01); *H01R 13/5219* (2013.01); *H01R 12/716* (2013.01)

(58) Field of Classification Search
CPC ..... H01R 13/02; H01R 13/52; H01R 13/405; H01R 43/18
(Continued)

(56) References Cited

U.S. PATENT DOCUMENTS 4,684,190 A * 8/1987 Clark ..... H01R 13/5219 439/277
8,662,927 B2 * 3/2014 Yu ..... H01R 4/023 439/498
(Continued)

FOREIGN PATENT DOCUMENTS

CN 204424570 U 6/2015
CN 105048150 A * 11/2015
CN 201510382072 A 11/2015

*Primary Examiner* — Tulsidas C Patel
*Assistant Examiner* — Peter G Leigh
(74) *Attorney, Agent, or Firm* — Molex, LLC

(57) ABSTRACT

An electrical connector has a terminal base, a metal inner shell, a metal fixing member and a metal outer shell. The terminal base comprises an insulative body and a plurality of conductive terminals fixed to the insulative body. The insulative body comprises a base and a tongue extended forwardly from the base. The base is provided with a plurality of latch projections. The metal inner shell encloses to form an accommodating cavity passing through from front to back and is used to accommodate the terminal base. The metal fixing member comprises a stopping ring portion and fixing portions bending and extending from both sides of the stopping ring portion. The stopping ring portion is provided with a through hole for the tongue to pass through. The fixing portions are provided with locking holes engaging with the latch projections of the terminal base, and the fixing portions are fixed to the metal inner shell. The metal outer shell is fixed to an outer side of the metal inner shell and is formed with a plurality of soldering legs extending downwardly. The present disclosure can effectively improve the reliability of the electrical connector.

9 Claims, 5 Drawing Sheets

(51) Int. Cl.
*H01R 13/405* (2006.01)
*H01R 12/71* (2011.01)

(58) Field of Classification Search
USPC ..... 439/271
See application file for complete search history.

(56) References Cited

U.S. PATENT DOCUMENTS 8,870,606 B2 * 10/2014 Yu ..... H01R 9/031 439/701
9,209,573 B1 * 12/2015 Chen ..... H01R 13/6581
9,281,643 B1 * 3/2016 Tseng ..... H01R 13/518
9,583,873 B2 * 2/2017 Wang ..... H01R 13/629
9,923,317 B2 3/2018 Yao et al.
2013/0337692 A1 * 12/2013 Yu ..... H01R 4/023 439/626
2013/0337703 A1 * 12/2013 Yu ..... H01R 9/031 439/701
2015/0093936 A1 * 4/2015 Little ..... H01R 13/6583 439/607.19
2015/0244111 A1 * 8/2015 Ju ..... H01R 13/6585 439/607.05
2015/0364864 A1 * 12/2015 Wang ..... H01R 13/629 439/607.01
2016/0064869 A1 * 3/2016 Yu ..... H01R 24/60 439/607.05
2016/0104976 A1 * 4/2016 Yu ..... H01R 13/6585 439/607.05
2016/0164218 A1 * 6/2016 Lee ..... H01R 13/5202 439/587
2016/0197443 A1 * 7/2016 Zhang ..... H01R 13/6585 439/607.05
2016/0329667 A1 * 11/2016 Tsai ..... H01R 24/70
2017/0018883 A1 * 1/2017 Chen ..... H01R 24/62
2017/0271822 A1 9/2017 Zhang

* cited by examiner

ELECTRICAL CONNECTOR WITH FORWARD AND REARWARD WATERPROOF SEALING

RELATED APPLICATIONS

This application claims priority to Chinese Application No. 201720244877.4, filed Mar. 14, 2017, which is incorporated herein by reference in its entirety.

TECHNICAL FIELD

The present disclosure relates to an electrical connector, and particularly relates to an electrical connector with high reliability.

BACKGROUND ART

Chinese Patent application CN201510382072.1 discloses a waterproof dual insertion orientation USB connector, which comprises a metal isolating middle plate, a first terminal group and a second terminal group respectively provided to both sides of the metal isolating middle plate, a metal fastener and a metal inner shell, the first and second terminal groups each comprise a contact portion and a soldering leg integrated with the contact portion, a first insulator is integrally formed on the first terminal group to form a first combination, a second insulator is integrally formed on the second terminal group to form a second combination, a third insulator is integrally formed to the metal isolating middle plate and the first or second combination to form a third combination, an insulative outer shell is integrally formed to the third combination and the second or first combination to form a fourth combination, the fourth combination comprises a mating portion mating with a mating connector, a retaining portion extending from a rear end of the mating portion, a tail portion formed to a rear end of the retaining portion and a step portion formed between the retaining portion and the tail portion, the first, second terminal groups and the metal isolating middle plate are integrally formed with and positioned in the insulative outer shell, the contact portions of the first, second terminal groups on a front end of the mating portion and the metal isolating middle plate between the contact portions are retained integrally by the insulative outer shell, the metal inner shell is sheathed on the step portion of the fourth combination, a gap between the metal inner shell and the step portion is sealed with a waterproof glue by a glue dispensing process.

Herein, the insulative outer shell is positioned in a front-rear direction by positioning tabs which are punched inwardly from the metal inner shell and the metal outer shell. This way of positioning the insulative outer shell needs to destroy the integrity of the metal inner shell and forms a through hole corresponding to the positioning tab, the waterproof performance is reduced. Moreover, the metal fastener is only sheathed to an outer periphery of a rear section of a tongue (that is the retaining portion), and because the metal fastener, the metal inner shell and the insulative outer shell are not securely engaged together, the metal fastener only tightly sheathes on the insulative outer shell to prevent the insulative outer shell from accidentally cracking and cannot firmly positions the insulative outer shell on the metal inner shell. In addition, since a dimension of an external contour of the connector is required to meet the interface specification, the metal fastener covering the rear section of the tongue will need to correspondingly reduce a thickness of the insulative outer shell of the rear section of the tongue, which will bring negative effect on the strength of the insulative outer shell. It can be seen that the existing matching structure between the insulative outer shell and the metal shell is defective, and the reliability of the connector is reduced, so it is really necessary to improve the connector.

SUMMARY

A technical problem to be resolved by the present disclosure is to provide an electrical connector, which can effectively improve the reliability of the electrical connector so as to overcome deficiencies in the prior art as above.

In view of the technical problem as above, the present disclosure provides an electrical connector comprising: a terminal base which comprises an insulative body and a plurality of conductive terminals fixed to the insulative body, the insulative body comprises a base and a tongue extended forwardly from the base, the base is provided with a plurality of latch projections; a metal inner shell which encloses to form an accommodating cavity passing through from front to back and used to accommodate the terminal base; a metal fixing member which comprises a stopping ring portion and two fixing portions bending from both sides of the stopping ring portion, the stopping ring portion is provided with a through hole for the tongue to pass therethrough, the fixing portions are provided with locking holes engaging with the latch projections of the terminal base, and the fixing portions are fixed to the metal inner shell; and a metal outer shell which is fixed to an outer side of the metal inner shell and is formed with a plurality of soldering legs extending downwardly.

In comparison with the prior art, by engaging the locking hole of the metal fixing member with the latch projection of the terminal base together and then sheathing the metal inner shell to the outer periphery of the metal fixing member and fixing the metal inner shell and the metal fixing member together, the electrical connector of the present disclosure may securely fix the terminal base 1 to the metal inner shell via the metal fixing member, and prevent the terminal base from being moved backwardly when the electrical connector mates with another mating connector and then may effectively improve the reliability of the electrical connector.

DETAILED DESCRIPTION OF THE PREFERRED EMBODIMENTS

While the present disclosure may be susceptible to embodiment in different forms, there is shown in the Figures, and will be described herein in detail, specific embodiments, with the understanding that the present disclosure is to be considered an exemplification of the principles of the present disclosure, and is not intended to limit the present disclosure to that as illustrated.

As such, references to a feature are intended to describe a feature of an example of the present disclosure, not to imply that every embodiment thereof must have the described feature. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the present disclosure, are not absolute, but relative. These representations are appropriate when the elements are in the position shown in the Figures. If the description of the position of the elements changes, however, these representations are to be changed accordingly.

Hereinafter preferred embodiments of the present disclosure will be further described in detail in combination with the accompanying figures.

Figure 1:
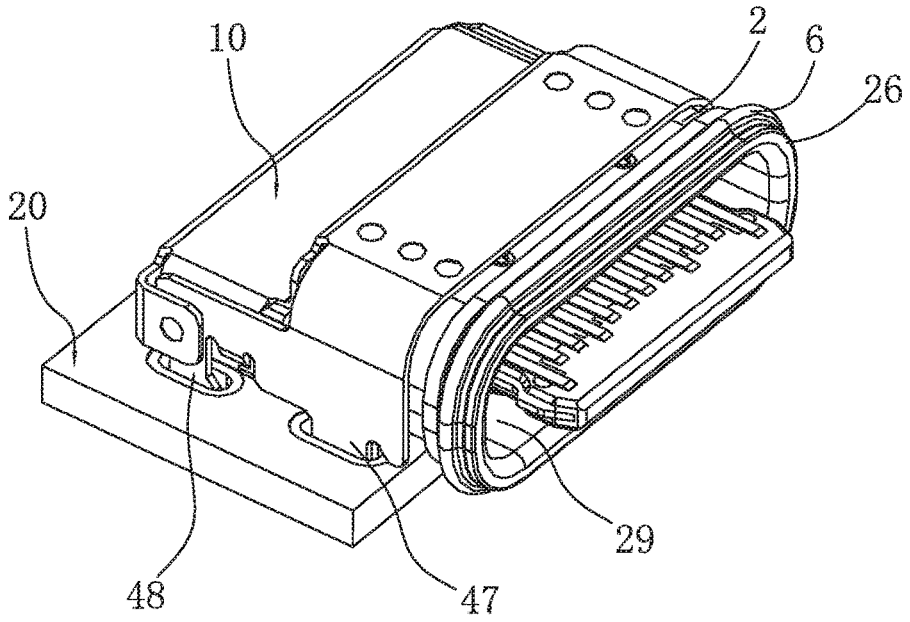
FIG. 1 is a perspective view of a preferred embodiment of an electrical connector and a circuit board of the present disclosure.
Figure 2:
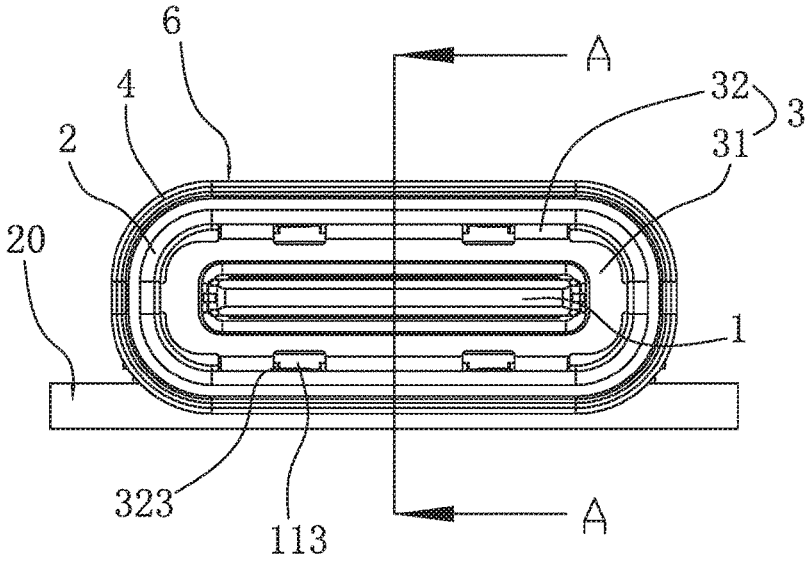
FIG. 2 is a front view of FIG. 1.
Figure 3:
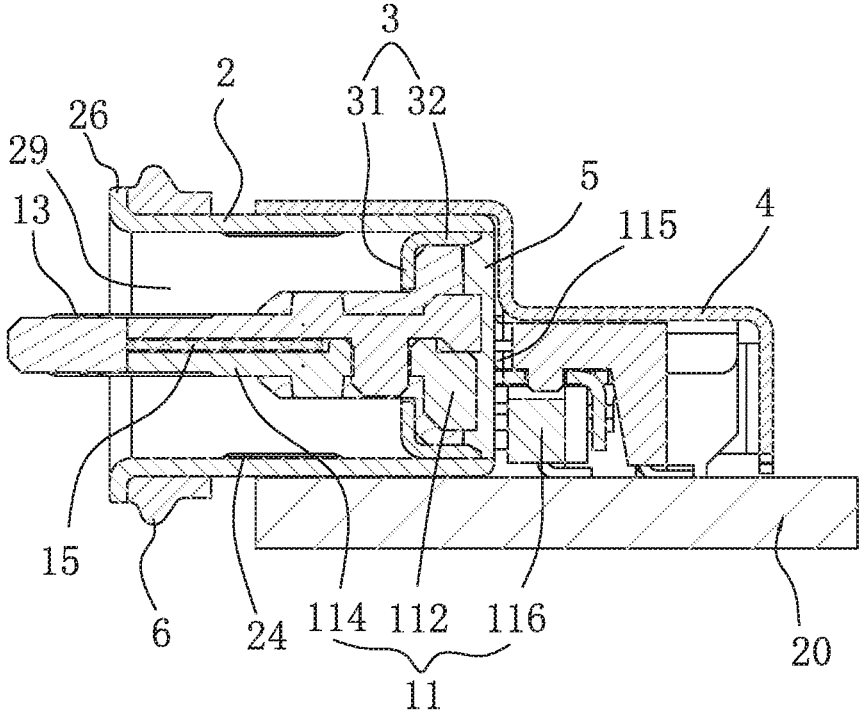
FIG. 3 is a cross-sectional view taken along a line A-A of FIG. 2.
Figure 4:
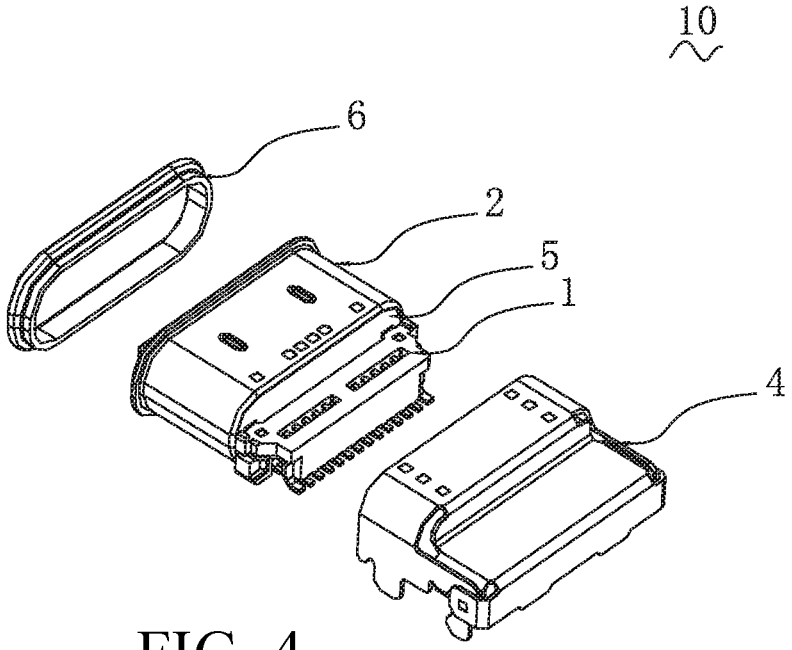
FIG. 4 is an exploded perspective view of an embodiment of an electrical connector of the present disclosure.
Figure 5:
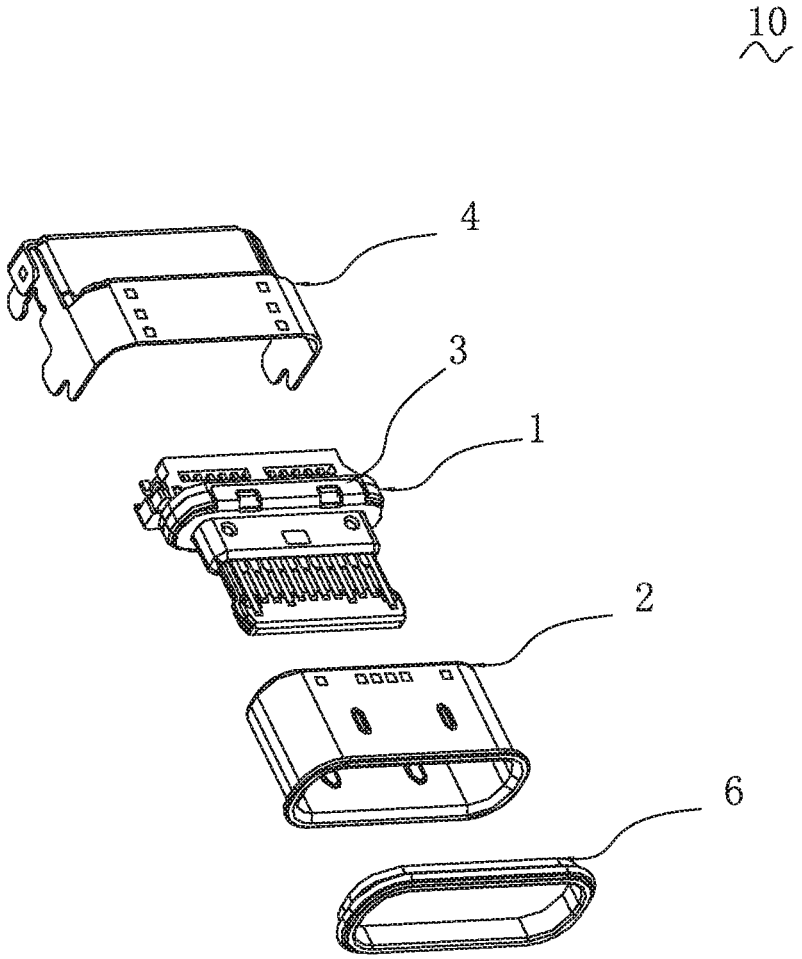
FIG. 5 is a further exploded perspective view on the basis of FIG. 4.

Referring to FIG. 1, FIG. 2 and FIG. 3, the present disclosure provides a waterproof USB type-C electrical connector 10, the electrical connector 10 is mounted on a circuit board 20 by a board mounting manner.

Combined with referring to FIG. 4 to FIG. 7, the electrical connector 10 comprises: a terminal base 1, a metal inner shell 2 sheathed on an outer periphery of the terminal base 1, a metal fixing member 3 mounted on the terminal base 1 and positioned inside the metal inner shell 2, a metal outer shell 4 mounted on an outer periphery of the metal inner shell 2, a waterproof glue 5 applied to a joint between the terminal base 1 and a rear end of the metal inner shell 2, and a sealing ring 6 surround an outer periphery of a front end of the metal inner shell 2.

Figure 6:
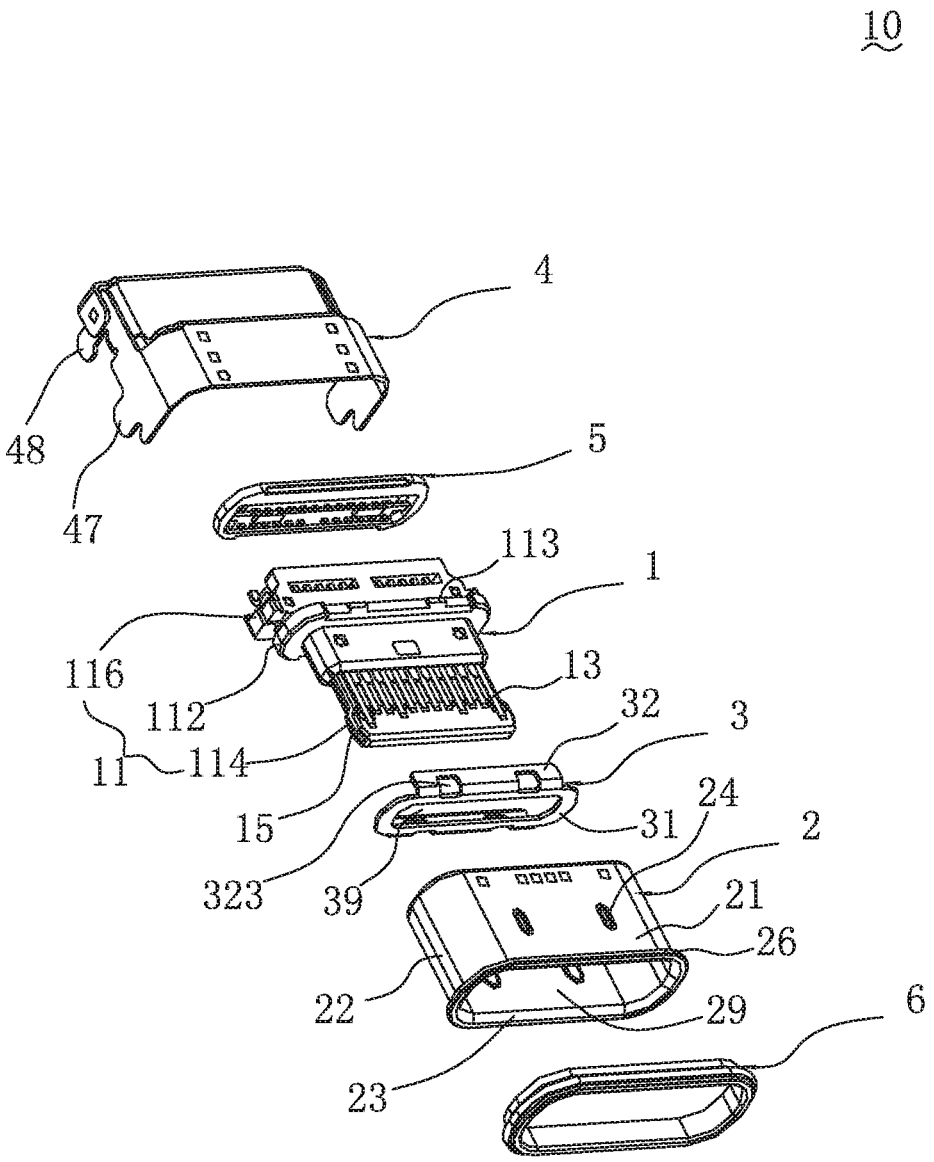
FIG. 6 and FIG. 7 are further exploded perspective views on the basis of FIG. 5 viewed from two different angles.
Figure 7:
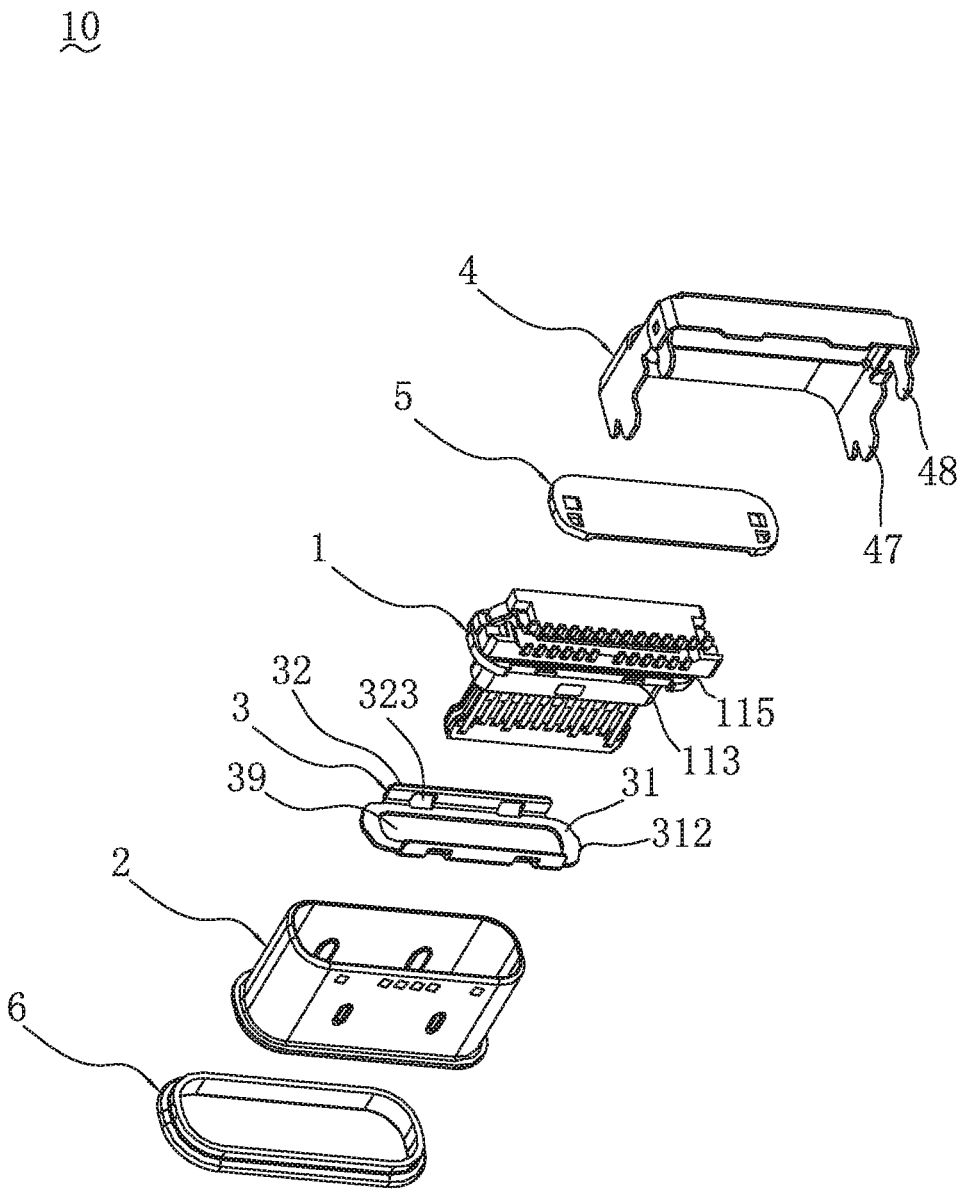

Referring to FIG. 3, FIG. 6 and FIG. 7, the terminal base 1 comprises an insulative body 11, and a plurality of conductive terminals 13 embedded in the insulative body 11 in an upper row and a lower row and a shielding sheet 15 spaced between the upper and lower rows of conductive terminals 13. The insulative body 11 comprises a base 112, a tongue 114 extending forwardly from the base 112 and a protruding portion 116 extending backwardly from the base 112. Top and bottom sides of the base 112 each are provided with two latch projections 113 protruding outwardly. The protruding portion 116 is provided with an glue-filling channel 115 passing through from top to bottom at a position close to the base 112, the plurality of conductive terminals 13 are embedded in the insulative body 11 and partially exposed to the glue-filling channel 115.

Referring to FIG. 3, FIG. 6 and FIG. 7, the metal inner shell 2 is formed to a hollow ring structure without an engaging slit by a metal drawing process. An accommodating cavity 29 is formed inside the metal inner shell 2 to pass through from front to back and accommodate the terminal base 1. The protruding portion 116 of the insulative body 11 protrudes backwardly from the accommodating cavity 29. The metal inner shell 2 is formed with a plurality of retaining projections 24 protruding inwardly, thus a retention force with another mating connector (not shown in the Figures) may be increased.

Specifically, the metal inner shell 2 comprises a top wall 21, two side walls 22 positioned at both sides of the top wall 21 and a bottom wall 23. The top wall 21 and the bottom wall 23 each are provided with the two retaining projections 24. A flange 26 rising outwardly is formed to surround the front end of the metal inner shell 2, which is beneficial to position and protect the sealing ring 6. A position of the rear end of the metal inner shell 2 is approximately consistent with a position of the glue-filling channel 115 of the insulative body 11 in the front-rear direction. In other words, the glue-filling channel 115 is positioned at a rear end of the accommodating cavity 29.

Referring to FIG. 2, FIG. 3, FIG. 6 and FIG. 7, the metal fixing member 3 is formed by integrally punching from a metal plate. The metal fixing member 3 comprises a stopping ring portion 31 and two fixing portions 32 bending and extending from upper and lower sides of the stopping ring portion 31. In the embodiment, the stopping ring portion 31 is a flat plate provided with a through hole 39 in the middle, the stopping ring portion 31 is uprightly provided on a vertical plane perpendicular to the front-rear direction, and a rear side surface of the stopping ring portion 31 is attached to a front side surface of the base 112; the stopping ring portion 31 with such a structure may reliably prevent the base 112 from slipping forwardly, and need not to thin a thickness at a rear side of the tongue 114 and also is beneficial to enhance a structural strength of the tongue 114. The fixing portion 32 is a flat plate bending backwardly and extending horizontally from a top side or a bottom side of the stopping ring portion 31. A rear end of the fixing portion 32 protrudes backwardly from a rear end surface of the base 112. The rear end of the metal inner shell 2 protrudes backwardly the rear end of the fixing portion 32.

The stopping ring portion 31 is provided with the through hole 39 for the tongue 114 of the terminal base 1 to pass through. The through hole 39 is slightly larger than a contour of the tongue 114 viewed from the front, so that the metal fixing member 3 could be sheathed and fixed backwardly to the base 112 from the front of the tongue 114. Two protruding edges 312 respectively protrude outwardly from left and right sides of the stopping ring portion 31. The two protruding edges 312 can correspondingly abut against inner side surfaces of the two side walls 22 of the metal inner shell 2 to achieve positioning and grounding of the metal inner shell 2.

The fixing portion 32 is provided with two locking holes 323 which may respectively engage with the latch projections 113 of the terminal base 1 so as to fix the metal fixing member 3 to the terminal base 1. In the embodiment, the locking hole 323 is penetratingly provided at a corner between the stopping ring portion 31 and the fixing portion 32. The fixing portion 32 is attached to an inner side of the top wall 21 or the bottom wall 23 of the metal inner shell 2, and fixed to the metal inner shell 2 by laser welding.

The stopping ring portion 31 of the metal fixing member 3 may prevent the terminal base 1 from moving forwardly, the locking holes 323 and the latch projections 113 engage with each other to prevent the terminal base 1 from moving backwardly, so that the terminal base 1 may be positioned and fixed to the metal inner shell 2 in the front-rear direction.

Referring to FIG. 1, FIG. 3, FIG. 6 and FIG. 7, the metal outer shell 4 is formed by integrally punching from a metal plate. The metal outer shell 4 is a cover structure open downwardly. The metal outer shell 4 may completely surround an outer periphery of the protruding portion 116 of the terminal base 1 to prevent electromagnetic radiation from leakage. The metal outer shell 4 is mounted on the outer periphery of the metal inner shell 2. In the embodiment, the metal outer shell 4 is laser welded to the metal inner shell 2. The metal outer shell 4 is formed with a plurality of soldering legs 47, 48 which extend downwardly and can be inserted and soldered to grounding pads of the circuit board 20 to achieve grounding of the metal outer shell 4, the metal inner shell 2 and the metal fixing member 3.

Referring to FIG. 3, FIG. 4, FIG. 6 and FIG. 7, the waterproof glue 5 is applied to the rear end surface of the base 112 of the insulative body 11 to seal a matching gap at the joint between the base 112 of the terminal base 1 and the rear end of the metal inner shell 2, so as to achieve the purpose of improving the waterproof performance of the connector. The waterproof glue 5 is preferably also filled in a front-end surface of the glue-filling channel 115 to seal a minor crack formed by the difference of materials of the conductive terminal 13 and the insulative body 11 under expansion and contraction, the waterproof glue 5 adheres the metal inner shell 2, the insulative body 11 and the conductive terminals 13, so as to wholly seal the rear end of the accommodating cavity 29 to meet the higher level of waterproofing requirement.

Referring to FIG. 3, FIG. 6 and FIG. 7, a front end of the sealing ring 6 is abutted by the flange 26 of the metal inner shell 2, so that the sealing ring 6 can be prevented from slipping forwardly. The sealing ring 6 cooperates with an outer casing of an electronic device (not shown in the Figures, such as an outer casing of a mobile phone) to prevent external water from entering via an engaging slit between the metal inner shell 2 and the outer casing of the electronic device and flowing backwardly into the inside of the electronic device.

In the embodiment, the sealing ring 6 is made of an insulative material with greater elasticity, such as a silica gel. This may enhance elastic deformation capability when the sealing ring 6 engages with the outer casing of the electronic device, so as to achieve a better waterproof sealing performance.

A manufacturing and assembling process of the electrical connector 10 generally comprises the following steps: combining the conductive terminals 13 and the shielding sheet 15 together with a insert molding method to obtain the terminal base 1; sheathing and fixing the metal fixing member 3 to the terminal base 1; sheathing the metal inner shell 2 to the outer periphery of the terminal base 1, and fixing the metal inner shell 2 to the metal fixing member 3 together by laser welding; applying the waterproof glue 5 to the rear end surface of the base 112 of the terminal base 1, and filling the waterproof glue 5 to the glue-filling channel 115; mounting the metal outer shell 4 and fixing the metal outer shell 4 to the metal inner shell 2 by welding; finally, mounting the sealing ring 6 to the front end of the metal inner shell 2.

In comparison with the prior art, by engaging the locking hole 323 of the metal fixing member 3 with the latch projection 113 of the terminal base 1 together and then sheathing the metal inner shell 2 to the outer periphery of the metal fixing member 3 and fixing the metal inner shell 2 and the metal fixing member 3 together, the electrical connector 10 of the present disclosure may securely fix the terminal base 1 to the metal inner shell 2 via the metal fixing member 3, and prevent the terminal base 1 from being moved backwardly when the electrical connector 10 mates with another mating connector (not shown in the Figures), and then may effectively improve the reliability of the electrical connector.

The above disclosure only relates to the embodiments of the present disclosure, but does not limit implementation modes of the present disclosure. According to main conception and spirit of the present disclosure, a person skilled in the art may conveniently make various variations or modifications. Therefore, the protection scope of the present disclosure is determined by the scope of the appended claims.

What is claimed is:

1. An electrical connector, comprising:

a terminal base which comprises an insulative body and a plurality of conductive terminals fixed to the insulative body, the insulative body comprising a base and a tongue extended forwardly from the base, the base being provided with a plurality of latch projections;

a metal inner shell which encloses to form an accommodating cavity passing through from front to back and used to accommodate the terminal base;

a metal fixing member which comprises a stopping ring portion and two fixing portions bending from both sides of the stopping ring portion, the stopping ring portion being provided with a through hole for the tongue to pass therethrough, the fixing portions being provided with locking holes engaging with the latch projections of the terminal base, and the fixing portions being fixed to the metal inner shell; and a metal outer shell which is fixed to an outer side of the metal inner shell and is formed with a plurality of soldering legs extending downwardly, wherein the stopping ring portion is a flat plate provided with the through hole in the middle, the stopping ring portion is uprightly provided on a vertical plane perpendicular to a front-rear direction, and a rear side surface of the stopping ring portion is attached to a front side surface of the base.

2. The electrical connector according to claim 1, wherein the fixing portions bend backwardly and extend horizontally from a top side and a bottom side of the stopping ring portion, the locking holes are penetratingly provided at a corner between the stopping ring portion and the fixing portions.

3. The electrical connector according to claim 1, wherein the metal fixing member is formed by integrally punching from a metal plate, and is fixed to the metal inner shell by laser welding.

4. The electrical connector according to claim 3, wherein the through hole of the metal fixing member is slightly larger than a contour of the tongue viewed from the front, so that the metal fixing member could be sheathed and fixed backwardly to the base from the front of the tongue.

5. The electrical connector according to claim 1, wherein two protruding edges protrude outwardly respectively from left and right sides of the stopping ring portion, the two protruding edges can correspondingly abut against an inner side surface of the metal inner shell.

6. The electrical connector according to claim 1, wherein the metal inner shell is a hollow ring structure without an engaging slit, the metal inner shell is formed with a plurality of retaining projections protruding inwardly for retaining a mating connector.

7. The electrical connector according to claim 6, the electrical connector further comprises a sealing ring provided around an outer periphery of a front end of the metal inner shell, a flange rising outwardly is formed to surround the front end of the metal inner shell, a front end of the sealing ring is abutted by the flange.

8. The electrical connector according to claim 1, the insulative body further comprises a protruding portion extending backwardly from the base, the protruding portion protrudes backwardly from the accommodating cavity; the metal outer shell surrounds an outer periphery of the protruding portion.

9. The electrical connector according to claim 8, wherein the protruding portion of the insulative body is provided with an glue-filling channel passing through from top to bottom at a position close to the base, the conductive terminals are embedded in the insulative body and partially exposed to the glue-filling channel; wherein a waterproof glue is applied to a rear end surface of the base of the insulative body, the waterproof glue is filled in the glue-filling channel and adheres the metal inner shell, the insulative body and the conductive terminals so as to wholly seal a rear end of the accommodating cavity.

* * * * *